US009011118B2

(12) United States Patent
Chou

(10) Patent No.: US 9,011,118 B2
(45) Date of Patent: Apr. 21, 2015

(54) AIR COMPRESSOR

(76) Inventor: Wen-San Chou, Tainan (TW)

( * ) Notice: Subject to any disclaimer, the term of this patent is extended or adjusted under 35 U.S.C. 154(b) by 124 days.

(21) Appl. No.: 13/301,489

(22) Filed: Nov. 21, 2011

(65) Prior Publication Data

US 2012/0189469 A1 Jul. 26, 2012

(30) Foreign Application Priority Data

Jan. 25, 2011 (TW) ..... 100102591 A

(51) Int. Cl.

| | |
|---|---|
| ***F04B 53/12*** | (2006.01) |
| ***F04B 35/01*** | (2006.01) |
| ***F04B 35/04*** | (2006.01) |
| ***F04B 39/12*** | (2006.01) |

(52) U.S. Cl.

CPC ..... *F04B 35/01* (2013.01); *F04B 35/04* (2013.01); *F04B 39/12* (2013.01)

(58) Field of Classification Search

CPC ..... F04B 35/04; F04B 39/121; F04B 53/143; F04B 2201/0209; F04B 2201/0808

USPC ..... 417/545, 550, 571; 92/140, 240, 169.1

See application file for complete search history.

(56) References Cited

U.S. PATENT DOCUMENTS

| | | | | |
|---|---|---|---|---|
| 2,023,466 | A * | 12/1935 | Crowley | 417/489 |
| 4,848,213 | A * | 7/1989 | Wood et al. | 92/172 |
| 6,655,928 | B2 * | 12/2003 | Chou | 417/360 |
| 7,179,064 | B2 * | 2/2007 | Folchert | 417/415 |
| 7,462,018 | B2 * | 12/2008 | Chou | 417/415 |
| 2007/0264139 | A1 * | 11/2007 | Chou | 417/415 |
| 2007/0264140 | A1 * | 11/2007 | Chou | 417/545 |
| 2008/0240943 | A1 * | 10/2008 | Wang | 417/361 |

* cited by examiner

*Primary Examiner* — Devon Kramer
*Assistant Examiner* — Joseph Herrmann
(74) *Attorney, Agent, or Firm* — Bacon & Thomas, PLLC

(57) ABSTRACT

An air compressor with enhanced air compressing effect comprises a mounting chassis with a coupling aperture, a piston having a piston rod with a crankpin linking bore and a piston head with an air acting face, a cylinder having an air chamber with an inner top wall, and a driving mechanism including a motor having a shaft and a rotational crank cam with an eccentric crankpin. The coupling aperture on the mounting chassis is bias disposed relative to the axial line of the cylinder. Both of the air acting face on piston head and inner top wall in cylinder are configured into corresponding slant planar surface. The eccentric crankpin on the crank cam pivotally links the crankpin linking bore on the piston rod of the piston so that rotary motion of the crank cam is converted into linear reciprocating motion. Thus, air compressing effect is substantially enhanced.

13 Claims, 17 Drawing Sheets

AIR COMPRESSOR

BACKGROUND OF THE INVENTION

1. Field of the Invention

The present invention relates to an air compressor comprising a mounting chassis, a piston having a piston head with an air acting face, a cylinder having an air chamber with an inner top wall, and a rotational crank cam with an eccentric crankpin. A coupling aperture on the mounting chassis is bias disposed. Both of the air acting face on piston head and inner top wall in cylinder are configured into corresponding slant planar surface. By linear reciprocating motion of the piston in the cylinder, the air in the cylinder is effectively compressed with enhanced efficiency.

2. Description of the Prior Art

The inventor of the present invention has been endeavoring research and development in air compressor for a long time with outstanding successful results such as converting conventional complicated type with laborious assembling process in early periods into simple structure with easy assembling process, enhancing conventional energy-wasting type into energy-effective and eco-friendly structure, or the like. All these achievements can be reflected from the following U.S. Patents issued to the inventor of the present invention: U.S. Pat. Nos. 5,215,447; 5,655,887; 6,135,725; 6,095,758; 6,213,725; 6,280,163; 6,315,534; 6,059,542; 6,146,112; 6,200,110; 6,295,693; 6,413,056; 6,551,077; 6,514,058; 6,655,928; 6,846,162; 7,462,018 and 7,240,642. For all foregoing air compressors, although each structure is different from preceding compressor to succeeding one, a common basic operation mode can be referred to FIG. 17, which is an indirectly driving transmission mode of meshed dual gears. Firstly, a motor 94 with a shaft 971 generates driving power to drive a coupled actively driving pinion 97 thereof; secondly, the driving power from the motor 94 is relayed by a passively driven gear 95, which is meshed with the actively driving pinion 97, to a coaxial rotational crank cam 96 stacked thereon; thirdly, an eccentric crankpin 961 on the rotational crank cam 96 simultaneously drives a linking bore 932 at rear end of a piston 98 into rotary motion such that the piston 98 with piston rod 983 are also driven to move; fourthly, at front end of the piston 98, a piston head 981 is driven by the moving piston rod 983 to move in linear reciprocating motion as the piston head 981 is confined by a cylindrical air chamber 911 of a cylinder 91; and finally, by means repeated linear reciprocating motion of the piston head 981 in the air chamber 911 of a cylinder 91, the air in the air chamber 911 is properly compressed to desired pressure.

FIG. 16 is an illustrative view showing structure of a piston 98 for conventional air compressor, wherein an air acting face 982 on the piston head 981 of the piston 98 has flat profile. Please refer to FIGS. 16 and 17, for outstanding highlight the flat profile of the air acting face 982 in the conventional air compressor, rest minor components related to the piston heads 981 are not shown in foregoing figures. Wherein:

$F_9$ denotes the central point of the air acting face 982 in conventional piston 98 (as shown in FIG. 16);

X-line, Y-line and Z-line denote X-axis, Y-axis and Z-axis of the three dimensional Cartesian coordinate system respectively such that X-axis, Y-axis and Z-axis intersect at origin point, which is consistent with point $P_0$ or $P_9$, which is defined as below;

XY-plane denotes the plane specified by the pair of X-axis and Y-axis;

XZ-plane denotes the plane specified by the pair of X-axis and Z-axis;

YZ-plane denotes the plane specified by the pair of Y-axis and Z-axis;

$I_v$ denotes a normal line initiated from $F_9$ (as shown in FIG. 16);

$I_{fp}$ denotes the line specified by the pair of point $P_0$ and point $F_9$ in conventional piston 98 (as shown in FIG. 16);

$P_9$ denotes the central point of the linking bore 932 in conventional piston 98 (as shown in FIG. 16);

$\theta_2$ denotes the angle formed by the XY-plane and flat air acting face 982 of the piston head 981 in conventional piston 98 (as shown in FIG. 17);

$\theta_4$ denotes the angle formed by the XY-plane and flat inner top wall 912 of the air chamber 911 in conventional cylinder 91 (as shown in FIG. 17); and The axial line of the linking bore 932 at rear end in the piston rod 983 of the piston 98, which is also a normal line passing point $P_9$, consists with the Y-axis so that the axial line is also laid on the XY-plane. The flat air acting face 982 on the piston head 981 of the piston 98 is disposed in parallel with the XY-plane so that the angle $\theta_2$ formed by the XY-plane and flat air acting face 982 of the piston head 981 is in $\theta_2=0$ condition. Likewise, the flat inner top wall 912 in the air chamber 911 of the cylinder 91 is also disposed in parallel with the XY-plane so that the angle $\theta_4$ formed by the XY-plane and flat inner top wall 912 of the air chamber 911 is in $\theta_4=0$ condition too.

Besides, a mounting chassis 90 with a proximal coupling aperture 922 and a distal coupling aperture 921 is provided for the conventional air compressor, wherein the proximal coupling aperture 922 functions to fix the motor 94 therebelow via passing the actively driving pinion 97 on a shaft 971 of the motor 94 therethrough while the distal coupling aperture 921 functions to fix the passively driven gear 95 thereon via holding a central spindle 951 in the passively driven gear 95. In this case, a cylinder axial line, which initiated from internal central point of the cylinder 91 such that it consists with the Z-axis, will mutually intersect both axial lines of the spindle 951 and shaft 971. Although foregoing structure of the conventional air compressor can bring features thereof to certain expected effect, there is some improving room for enhancing performance of the air compressor. Having addressed the structural features and issues of the conventional air compressor, the inventor of the present invention contrives innovative mounting chassis and piston for enhancing air compressing effect.

SUMMARY OF THE INVENTION

Accordingly, the primary object of the present invention is to provide an air compressor, which comprises a housing with cylinder and a mounting chassis with a coupling aperture such that a hypothetically extended normal line initiated the central point of the coupling aperture in perpendicular to the mounting chassis does not intersect with an axial line initiated from internal central point of the cylinder. Thereby, overall air compressing effect for the air compressor of the present invention is substantially enhanced owing to better airtight property.

Another object of the present invention is to provide an air compressor, which comprises a piston with a piston head at front end thereof and a piston rod with a crankpin linking bore at rear end thereof such that said crankpin linking bore can be driven by the driving mechanism while said piston head is accommodated by the cylinder for performing linear reciprocating motion therein. Moreover, the top surface of said piston head is formed into an air acting face with slant profile instead of a flat plane in perpendicular to the piston rod.

The other object of the present invention is to provide an air compressor, which comprises a cylinder including an air chamber with an inner top wall such that the inner top wall is formed with a slant profile in corresponding with the slant profile of the air acting face on the piston head of the piston.

DESCRIPTION OF THE PREFERRED EMBODIMENTS

Figure 1:
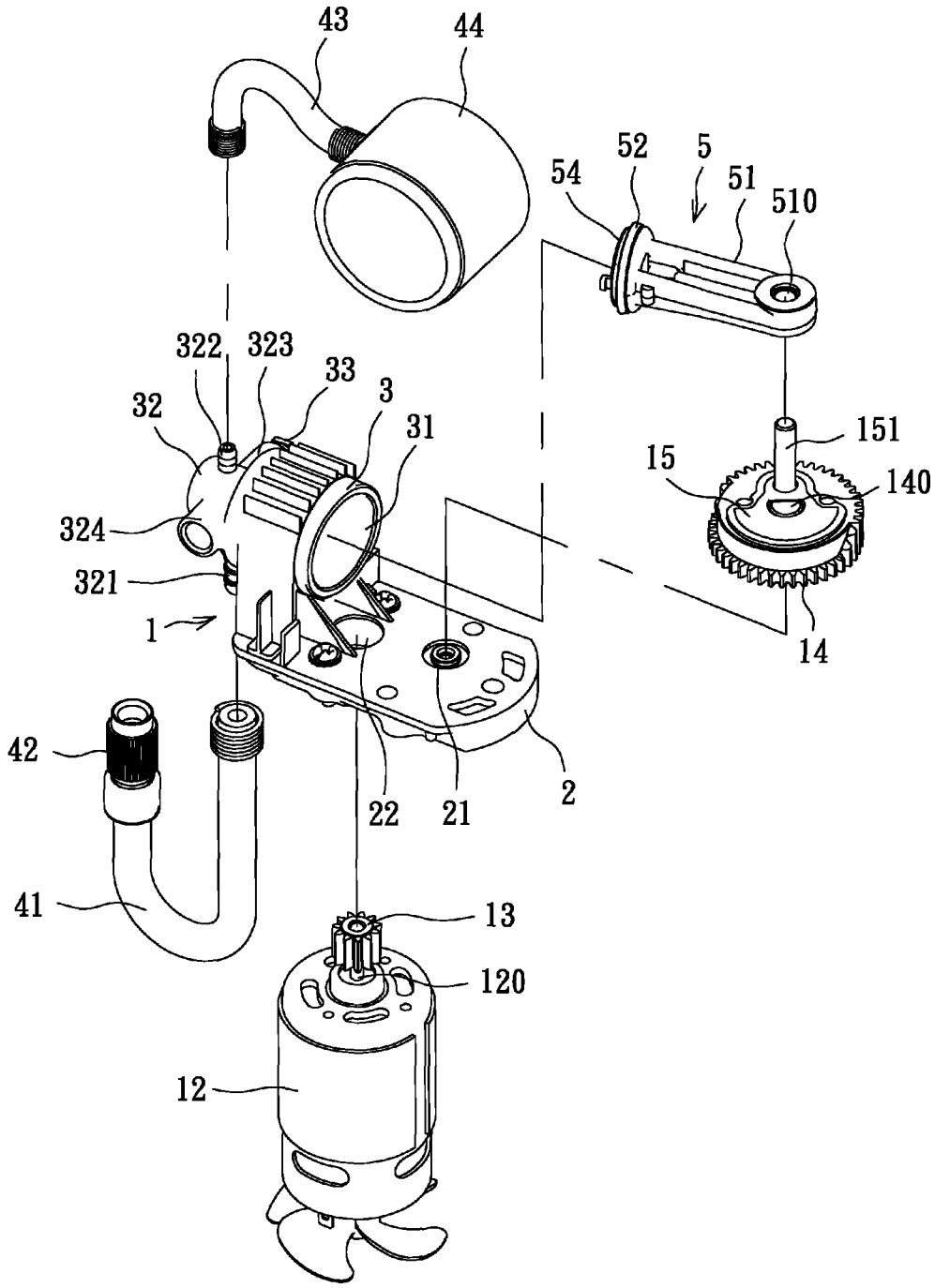
FIG. 1 is an exploded view showing structure of an air compressor for the first exemplary preferred embodiment of the present invention.
Figure 2:
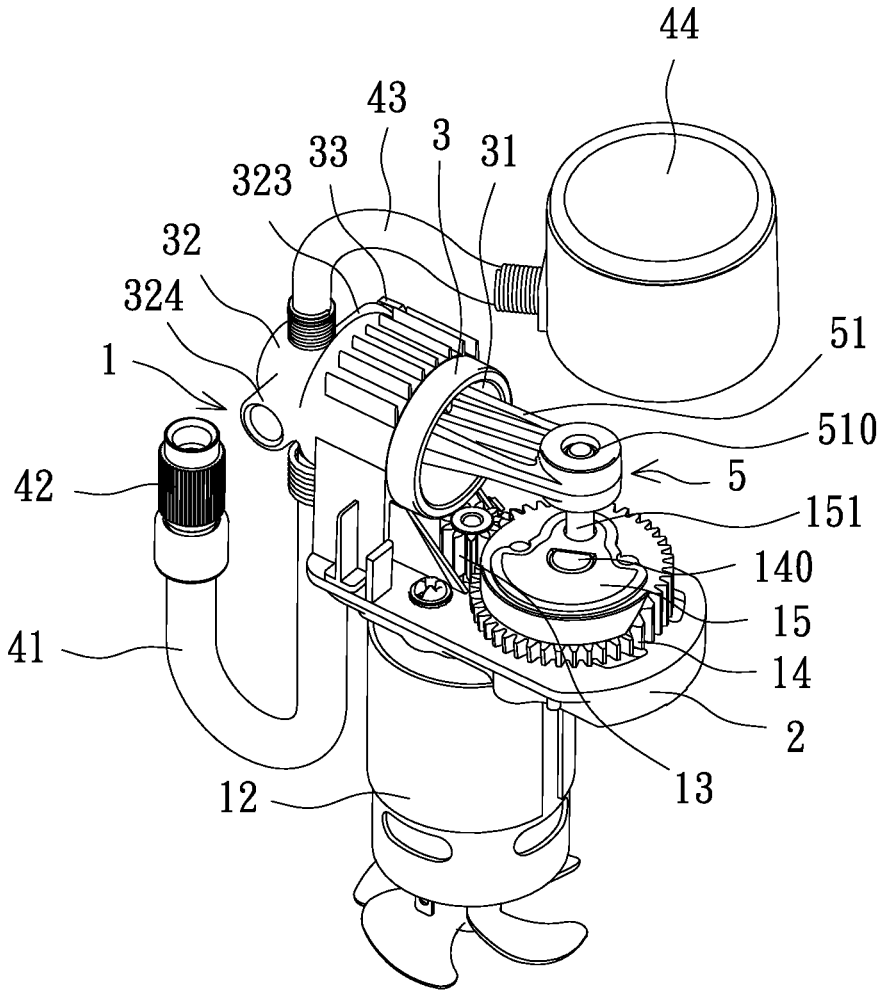
FIG. 2 is a perspective view showing an assembled air compressor for previous FIG. 1.
Figure 5:
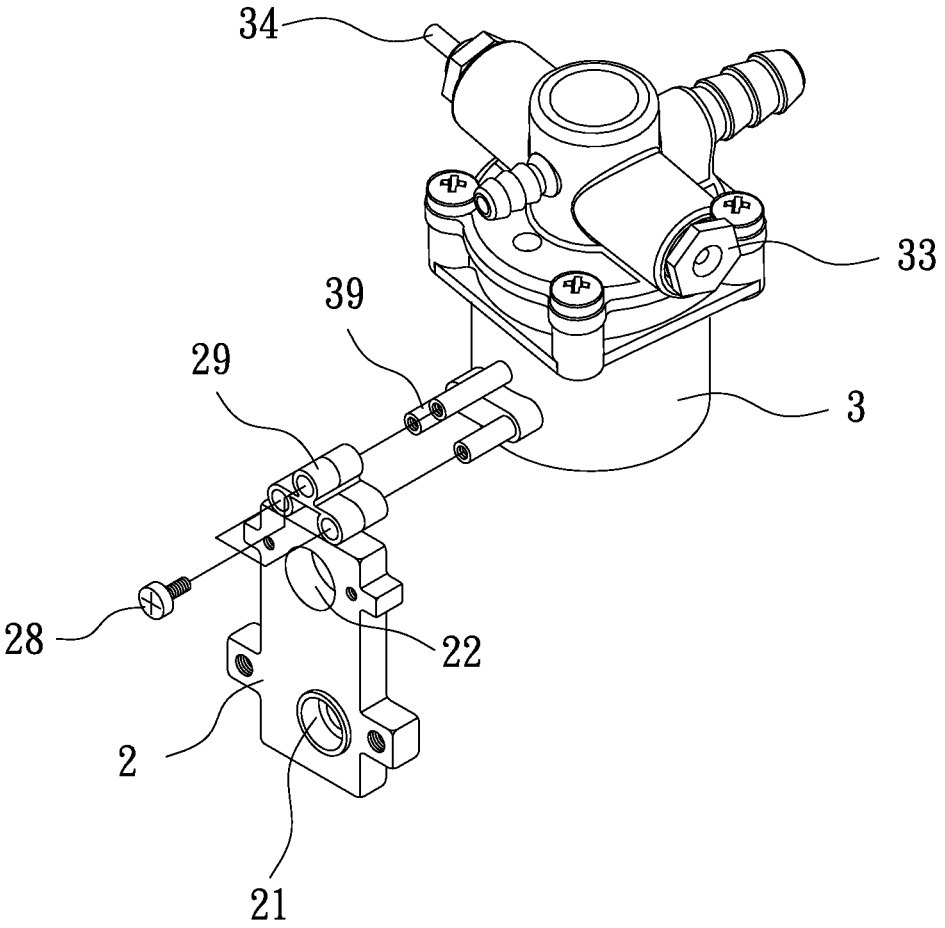
FIG. 5 is an illustrative view showing a flexibly adapted detachable joint of a mounting chassis and a cylinder in an air compressor for the third exemplary preferred embodiment of the present invention.

For understanding specific structure, application and features of the present invention, some preferred exemplary embodiments are disclosed in detailed manner below with associated drawings. Please refer to FIGS. 1 and 2, which show structure of an air compressor for the first exemplary preferred embodiment of the present invention. Two kinds of basic driving transmission mode are available for the exemplary preferred embodiments. They are indirectly driving transmission mode of meshed dual gears and directly driving transmission mode of single gear. The air compressor in this embodiment, which is an indirectly driving transmission mode of meshed dual gears, basically comprises a housing 1, a mounting chassis 2, a cylinder 3, a piston 5, a discharge mount 32 and a driving mechanism including a motor 12 with an actively driving pinion 13 and a passively driven gear 14 with a rotational crank cam 15, on which is provided an eccentric crankpin 151, wherein:

Said housing 1, which is an independent unitarily formed integral entity, serves to mainly accommodate the mounting chassis 2, motor 12, cylinder 3, piston 5 and discharge mount 32;

Said mounting chassis 2, which serves to fix the driving mechanism thereon, includes a distal coupling aperture 21 and a proximal coupling aperture 22, wherein the proximal coupling aperture 22 functions to fix the motor 12 therebelow by bolts (not shown in figures) via passing the actively driving pinion 13 on a shaft 120 of the motor 12 therethrough while the distal coupling aperture 21 functions to fix the passively driven gear 14 thereon via holding a central spindle 140 in the passively driven gear 14 so that the passively driven gear 14 is meshed and driven by the actively driving pinion 13, wherein the spindle 140 also serves to fix the crank cam 15 on the passively driven gear 14 while the eccentric crankpin 151 on the crank cam 15 functions to pivotally linked with the piston 5 via a crankpin linking bore 510 of which;

Said piston 5, which functions as a compressing member of reciprocating motion in the cylinder 3, includes a piston rod or pitman 51 with a crankpin linking bore 510 at rear end thereof, and a piston head 52 with a slant air acting face 54 at front end thereof;

Said cylinder 3, which is a hollow barrel, includes an air chamber 31 encompassed by a slant inner top wall 311 (FIG. 9), a cylindrical inner wall 312 and the slant air acting face 54 of the piston 5;

Said discharge mount 32 (FIGS. 1 and 9), which receives compressed inflow air from the cylinder 3 via an internal cavity 320 thereof, includes a discharge manifold of four orifices 321, 322, 323, 324 such that the orifice 321 optionally connects to a hoses or pipes 41 with a nozzle 42 while orifice 321 optionally connects to another hose or pipe 43 with a pressure gauge or pressure meter 44; Whereas, the orifices 323 and 324 can either optionally connects to certain functional devices such as a safety valve 33, a discharge valve 34 (as shown in FIG. 5) or pipe head plug and pipe end cap (not shown in figures) if in idle condition;

Said motor 12, which generates driving power, includes a shaft 120 with an actively driving pinion 13;

Said actively driving pinion 13, which mounts on the shaft 120 and passes through the proximal coupling aperture 22 in the mounting chassis 2, meshes with the passively driven gear 14 so that integral of both actively driving pinion 13 and passively driven gear 14 relays driving power from the motor 12 to the piston 5;

Said passively driven gear 14, which mounts to the distal coupling aperture 21 in the mounting chassis 2 via a spindle 140 thereof, meshes with the actively driving pinion 13 so that the driving power in less torque of the small actively driving pinion 13 can be relayed and converted into the driving power in more torque of the large passively driven gear 14;

Said crank cam 15, which securely stacks over and simultaneously rotates with the passively driven gear 14 in coaxial manner to the spindle 140, has an eccentric crankpin 151 and a cam lobe disposed in respectively opposed side of the spindle 140 so that each of the eccentric crankpin 151 and cam lobe acts as counterbalance to each other;

Said eccentric crankpin 151, which snugly runs through the crankpin linking bore 510 at the rear end of the piston 5 in pivotal joint manner, converts the rotary motion of the crank cam 15 with passively driven gear 14 into reciprocating motion of the piston 5.

With all foregoing parts of the air compressor for the first exemplary preferred embodiment of the present invention, upon the motor 12 turning power on, the driving power generated from the motor 12 will be relayed via integral of meshed actively driving pinion 13 and passively driven gear 14 with crank cam 15 to the piston 5 for reciprocating motion to compress air in the air chamber 31 of the cylinder 3, where the compressed air will be expelled to the internal cavity 320 of the discharge mount 32.

Figure 3:
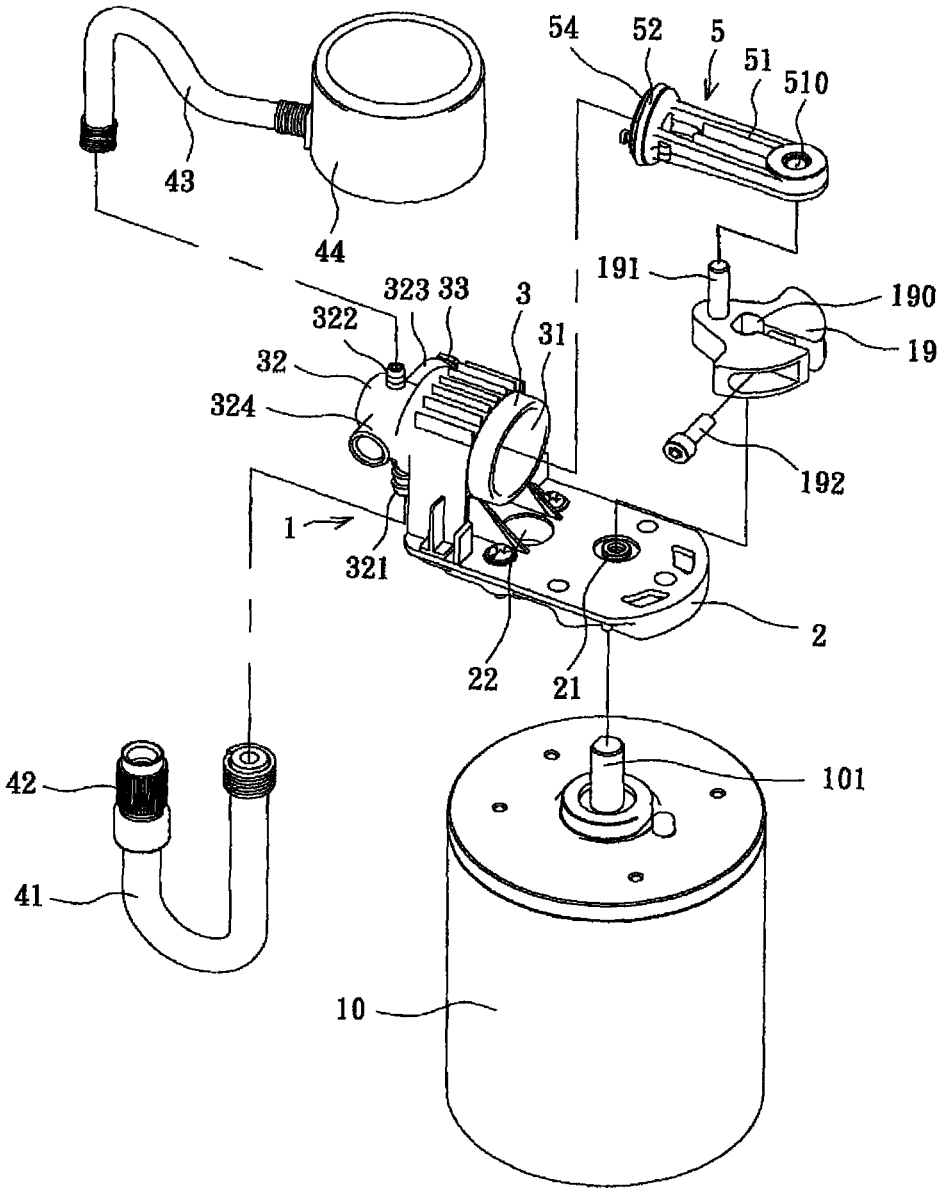
FIG. 3 is an exploded view showing structure of an air compressor for the second exemplary preferred embodiment of the present invention.
Figure 4:
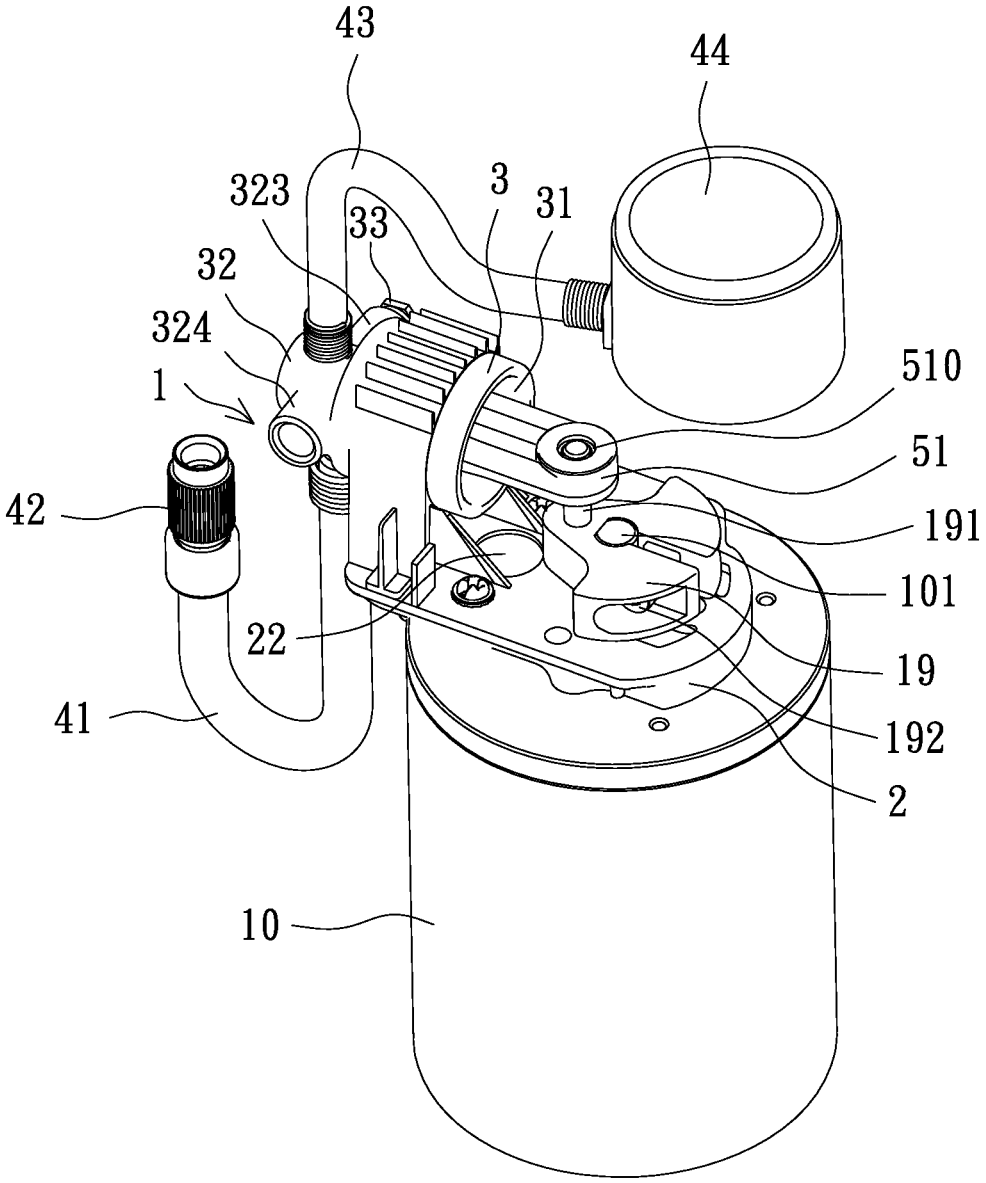
FIG. 4 is a perspective view showing an assembled air compressor for previous FIG. 3.

Please refer to FIGS. 3 and 4, which show structure of an air compressor in a directly driving transmission mode of single gear for the second exemplary preferred embodiment of the present invention. The air compressor in this embodiment basically comprises a housing 1, a mounting chassis 2, a cylinder 3, a piston 5, a discharge mount 32 and a driving mechanism including a motor 10 and a rotational crank cam 19, on which is provided an eccentric crankpin 191, wherein:

Said housing 1, which is an independent unitarily formed integral entity, serves to mainly accommodate the mounting chassis 2, motor 10, cylinder 3, piston 5 and discharge mount 32;

Said mounting chassis 2, which serves to fix the driving mechanism thereon, includes a distal coupling aperture 21 and a proximal coupling aperture 22, wherein the distal coupling aperture 21 functions to fix the motor 10 therebelow by bolts (not shown in figures) while the proximal coupling aperture 22 is idle;

Said motor 10, which generates driving power, includes a shaft 101, which integrates and links the mounting chassis 2, crank cam 19 and piston 5 with the motor 10 by orderly running itself through the distal coupling aperture 21 of the mounting chassis 2 and a coupling bore 190 of the crank cam 19, and a crankpin linking bore 510 at the rear end of the piston 5 receives an eccentric crankpin 191;

Said crank cam 19 has a coupling bore 190, an eccentric crankpin 191 and a pair of split cam lobes disposed in respectively opposed side of the coupling bore 190 so that each of the eccentric crankpin 191 and pair cam lobes acts as counterbalance to each other;

Said eccentric crankpin 191, which snugly runs through the crankpin linking bore 510 at the rear end of the piston 5 in pivotal joint manner, converts the rotary motion of the crank cam 19 into reciprocating motion of the piston 5.

Like the status in the first exemplary preferred embodiment, with all foregoing parts of the air compressor for the second exemplary preferred embodiment of the present invention, upon the motor 10 turning power on, the driving power generated from the motor 10 will be relayed via the crank cam 19 to the piston 5 for reciprocating motion to compress air in the air chamber 31 of the cylinder 3, where the compressed air will be expelled to the internal cavity 320 of the discharge mount 32.

Other than foregoing two kinds of basic driving transmission mode those are indirectly driving transmission mode of meshed dual gears and directly driving transmission mode of single gear, a flexibly adapted detachable joint of a mounting chassis and a cylinder is also available. As shown in FIG. 5, a set of jointing bores 29 in the mounting chassis 2 are corresponded with a set of jointing stems 39 on the cylinder 3. Both of mounting chassis 2 and cylinder 3 can be firmly mated mutually by tightening up of a set of bolts 28, which run through the jointing bores 29 and corresponding jointing stems 39. The technology can be referred to U.S. Pat. No. 6,655,928, which is issued to the inventor of the present invention.

In summary, either in the indirectly driving transmission mode of meshed dual gears for the first embodiment or the directly driving transmission mode of single gear for the second embodiment, the eccentric crankpin 151/191 on the crank cam 15/19 in each driving mechanism is driven to rotate in rotary motion so that the linking bore 510 at the rear end of the piston rod 51 is linked to rotate in same manner of rotary motion simultaneously. Since the piston head 52 at the front end of the piston 5 is snugly confined by the straight cylindrical inner wall 312 of the cylinder 3, it can only perform linear motion along the straight cylindrical inner wall 312. Thereby, the piston rod 51 will convert the rotary motion of the linking bore 510 at the rear end thereof into a linear reciprocating motion of the piston head 52 at the front end thereof. Thus, the driving power generated from the motor 10 will be relayed via the crank cam 15/19 to the piston 5 for linear reciprocating motion of the piston head 52 to compress air in the air chamber 31 of the cylinder 3, where the compressed air will be expelled to the internal cavity 320 of the discharge mount 32. Finally, the compressed air can be released via the orifice 321 and expelled to the nozzle 42 for inflating the target object.

Figure 6:
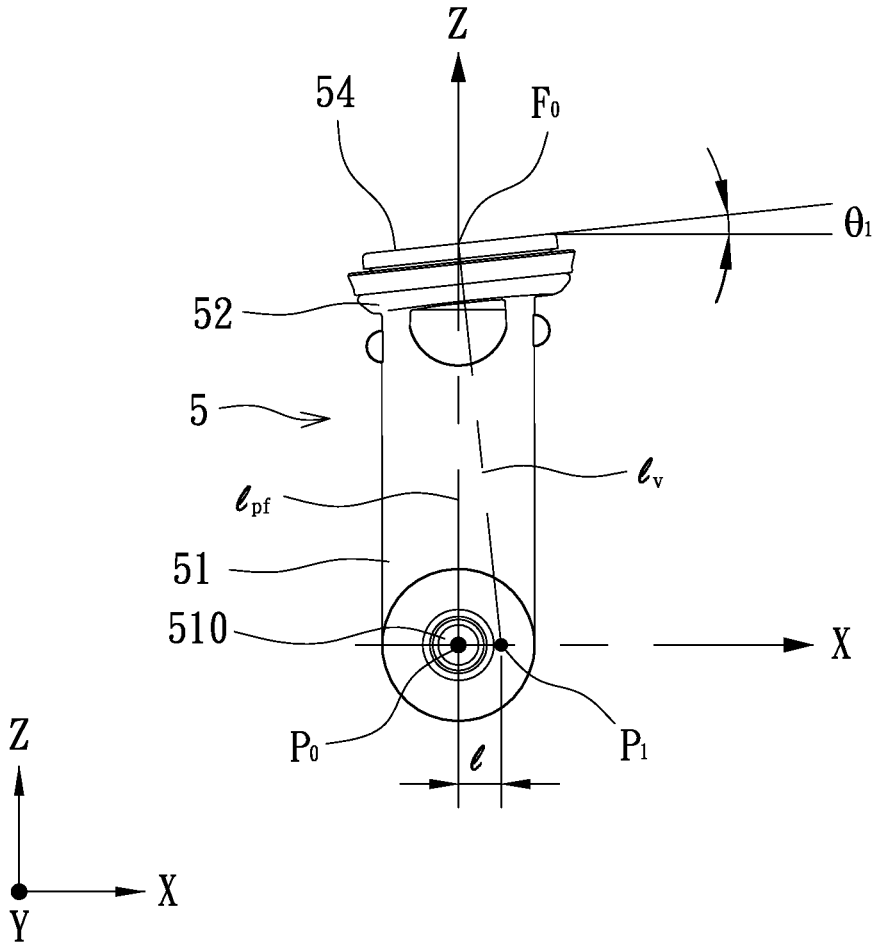
FIG. 6 is an illustrative view showing structure of a piston for foregoing exemplary preferred embodiments of the present invention.
Figure 7:
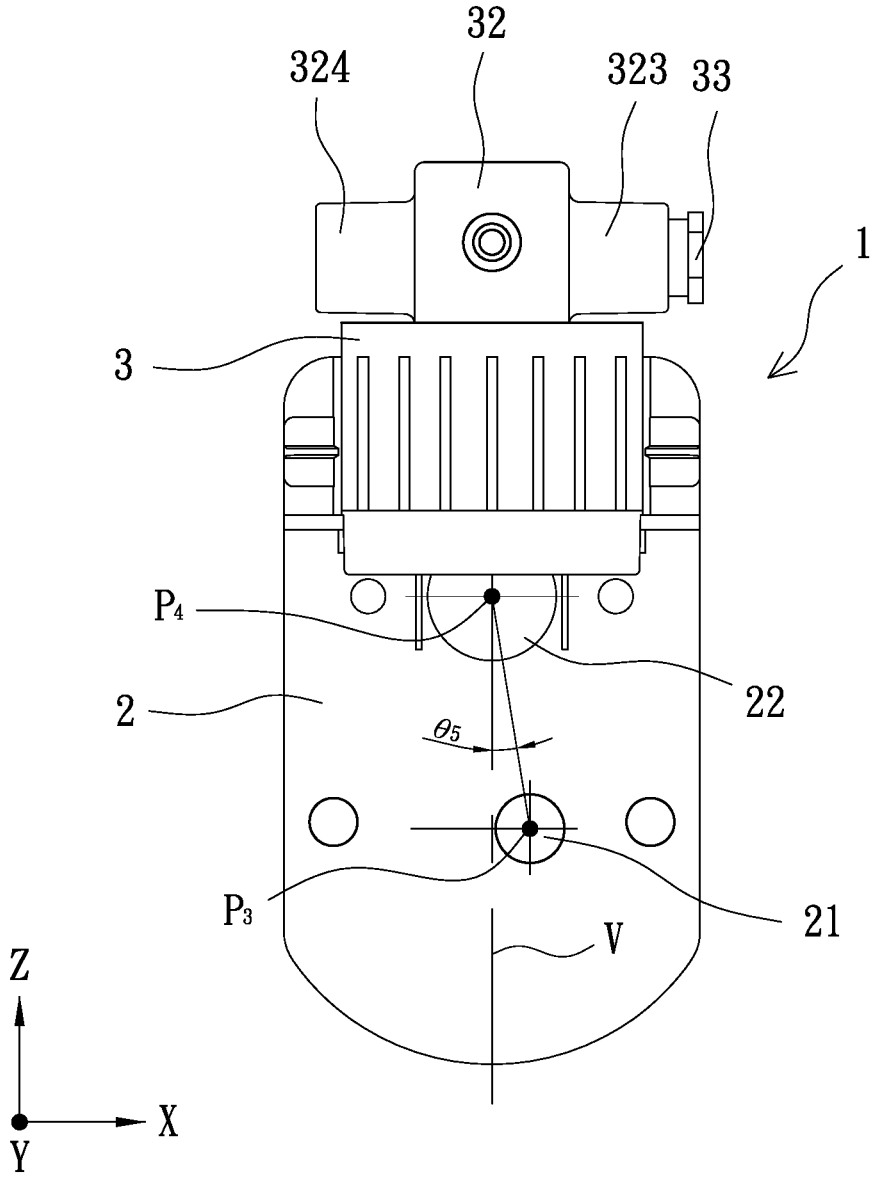
FIG. 7 is a facade view showing structure of housing for foregoing exemplary preferred embodiments of the present invention.
Figure 8:
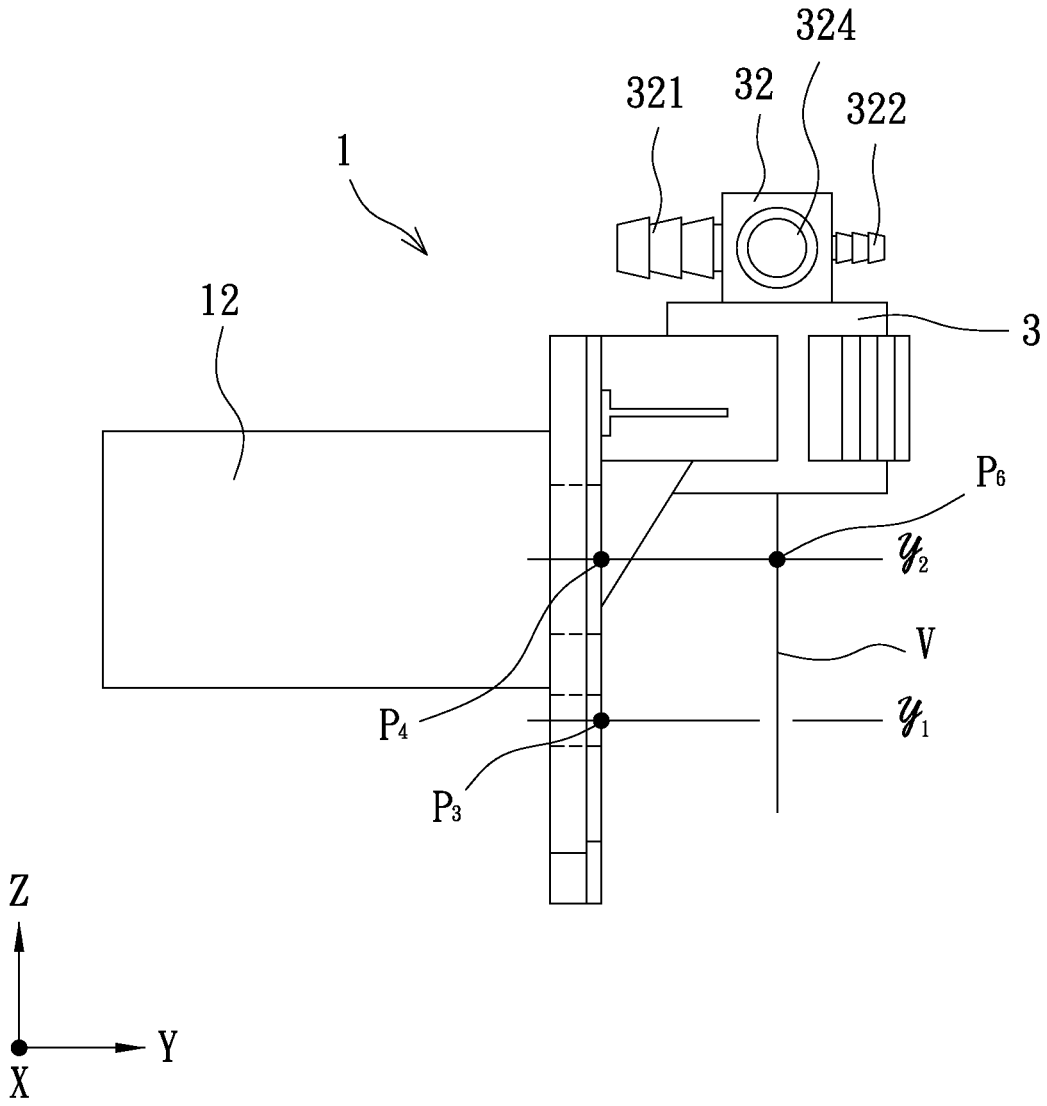
FIG. 8 is a lateral view showing structure of housing for foregoing exemplary preferred embodiments of the present invention.
Figure 9:
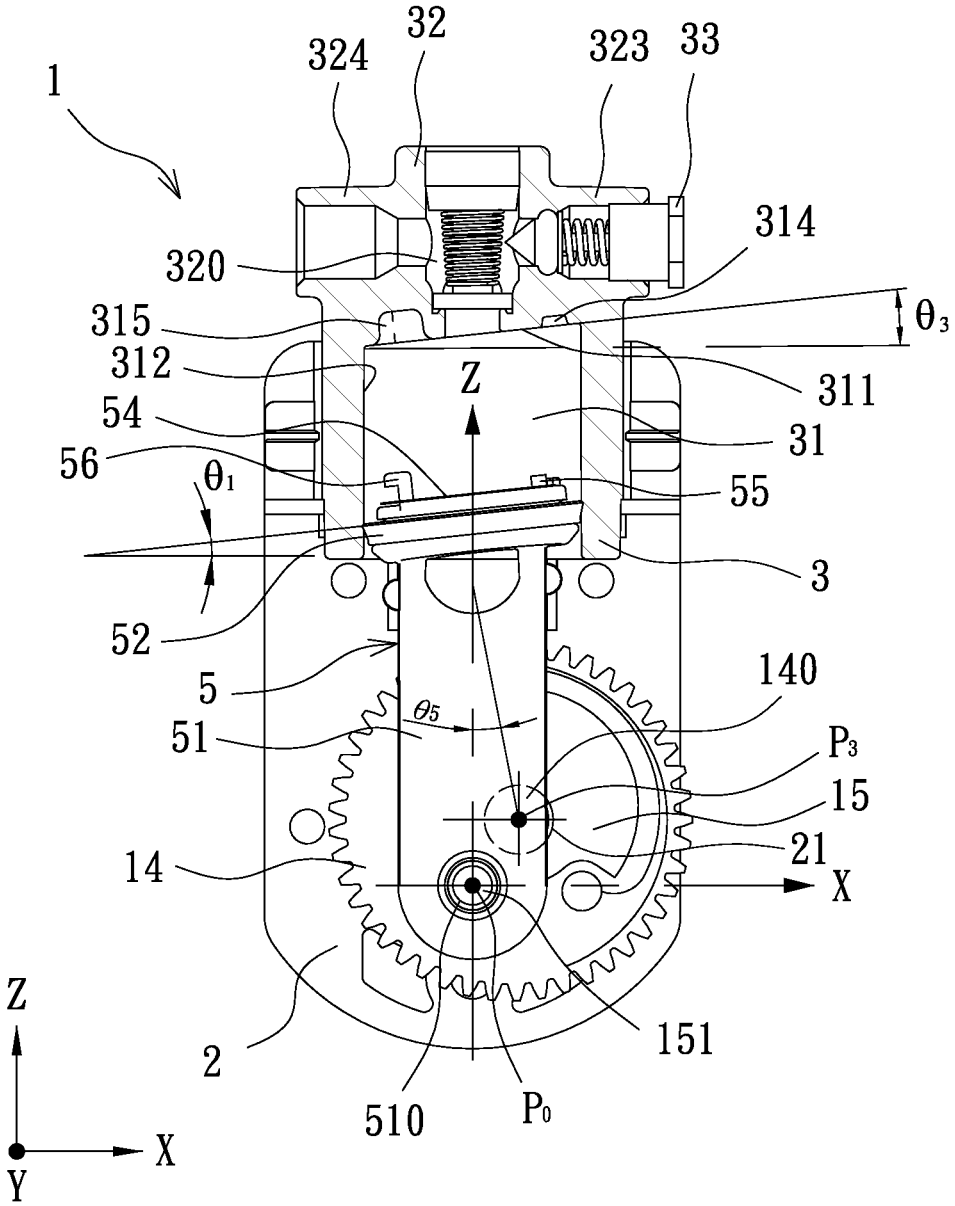
FIG. 9 is a partial sectional view showing driving mechanism in assembly of piston and housing for foregoing exemplary preferred embodiments of the present invention.
Figure 16:
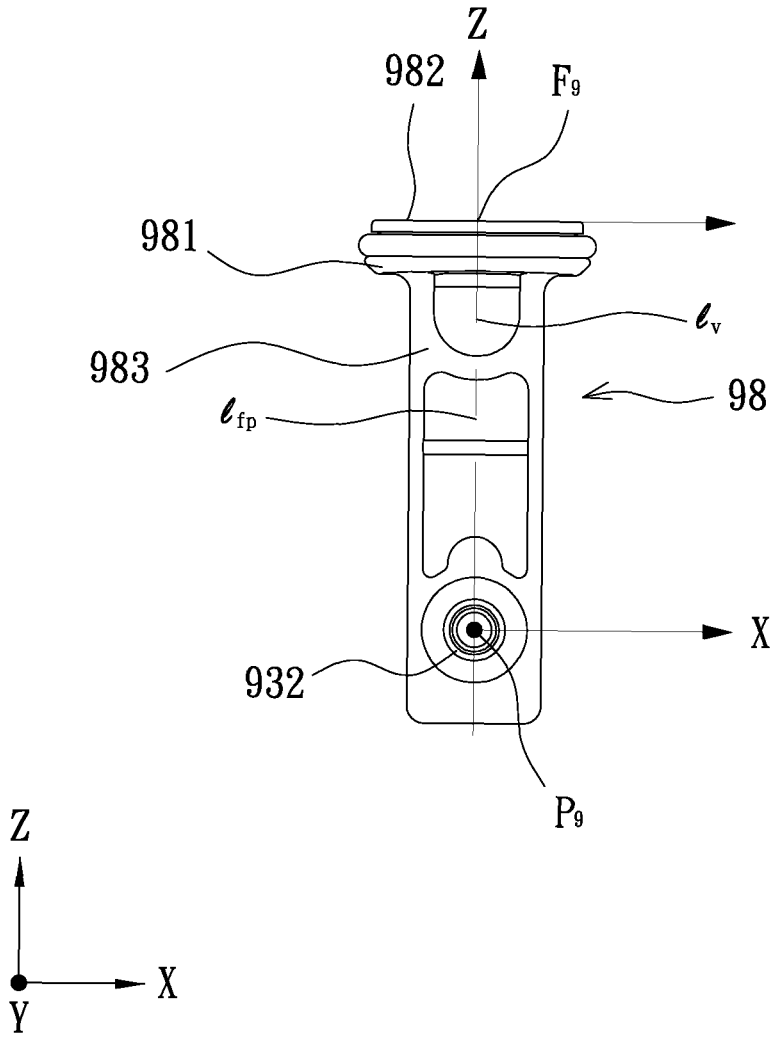
FIG. 16 PRIOR ART
FIG. 16 is an illustrative view showing structure of a piston for conventional air compressor.
Figure 17:
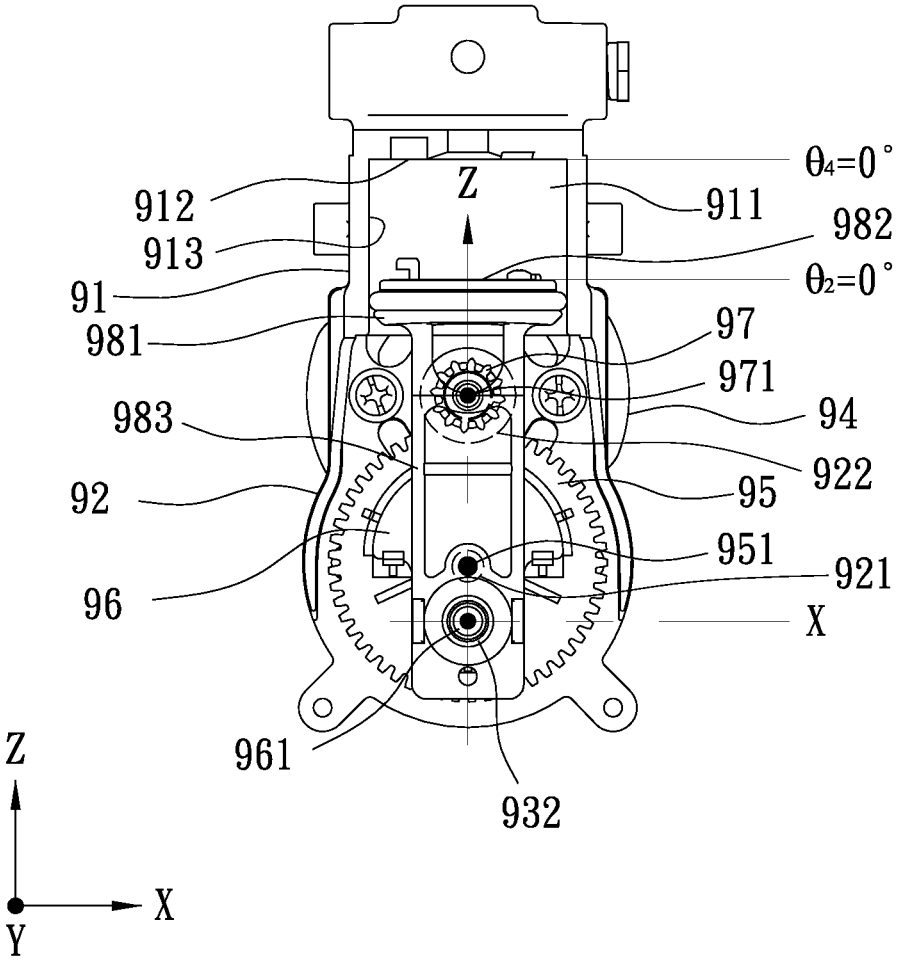
FIG. 17 PRIOR ART
FIG. 17 is a partial sectional view showing a piston accommodated in a cylinder for conventional air compressor.

As described above, the piston 5 includes a piston rod or pitman 51, a piston head 52 with a slant air acting face 54 at front end thereof and a crankpin linking bore 510 at rear end thereof (as shown in FIG. 9), a further disclosure for the innovative contrivance of the piston 5 is manifested below via demonstration of associated FIG. 6 and relevant three-dimensional Cartesian coordinate system. Please refer to FIGS. 6 through 9 for the air compressor of the present invention and FIGS. 15 and 16 for conventional air compressor as contrastive comparison. For outstanding highlight between slant profile of the air acting face 54 in the air compressor of the present invention and flat profile of the air acting face 982 in the conventional air compressor, rest minor components related to the piston heads 52 and 981 are not shown in foregoing figures. Wherein:

$P_0$ denotes the central point of the crankpin linking bore 510 of the present invention (as shown in FIG. 6);

$F_9$ denotes the central point of the air acting face 54 in the piston 5 of the present invention (as shown in FIG. 6);

$F_9$ denotes the central point of the air acting face 982 in conventional piston 98 (as shown in FIG. 16);

X-line, Y-line and Z-line denote X-axis, Y-axis and Z-axis of the three dimensional Cartesian coordinate system respectively such that X-axis, Y-axis and Z-axis intersect at origin point, which is consistent with point $P_0$ or $P_9$, which is defined as below;

XY-plane denotes the plane specified by the pair of X-axis and Y-axis;

XZ-plane denotes the plane specified by the pair of X-axis and Z-axis;

YZ-plane denotes the plane specified by the pair of Y-axis and Z-axis;

V-line denotes an axial line initiated from internal central point of the cylinder 3 such that it always in parallel with the Z-axis (as shown in FIGS. 7 and 8);

$I_v$ denotes a normal line initiated from $F_0$ or $F_9$ (as shown in FIGS. 6 and 16);

$I_{pf}$ denotes the line specified by the pair of point $P_0$ and point $F_0$ in the piston 5 of the present invention (as shown in FIG. 6);

$I_{fp}$ denotes the line specified by the pair of point $P_0$ and point $F_9$ in conventional piston 98 (as shown in FIG. 16);

$P_1$ denotes the intersect point of the line $I_v$ and the XY-plane (as shown in FIG. 6);

I denotes the distance between the point $P_1$ and the point $P_0$ (as shown in FIG. 6);

$P_3$ denotes the central point of the distal coupling aperture 21 in the mounting chassis 2 of the present invention (as shown in FIG. 7);

$P_4$ denotes the central point of the proximal coupling aperture 22 in the mounting chassis 2 of the present invention (as shown in FIG. 7);

$Y_1$-line denotes a hypothetically extended line initiated from point $P_3$ in parallel with Y-axis (as shown in FIG. 8);

$Y_2$-line denotes a hypothetically extended line initiated from point $P_4$ in parallel with Y-axis (as shown in FIG. 8);

$P_6$ denotes the point intersected by the V-line and hypothetical $Y_2$-line for the air compressor of the present invention (as shown in FIG. 8);

$P_9$ denotes the central point of the linking bore 932 in conventional piston 98 (as shown in FIG. 16);

$\theta_1$ denotes the angle formed by the XY-plane and slant air acting face 54 of the piston head 52 in the piston 5 of the present invention (as shown in FIGS. 6 and 9);

$\theta_2$ denotes the angle formed by the XY-plane and flat air acting face 982 of the piston head 981 in conventional piston 98 (as shown in FIG. 17);

$\theta_3$ denotes the angle formed by the XY-plane and slant inner top wall 311 of the air chamber 31 in the cylinder 3 of the present invention (as shown in FIG. 9);

$\theta_4$ denotes the angle formed by the XY-plane and flat inner top wall 912 of the air chamber 911 in conventional cylinder 91 (as shown in FIG. 17); and $\theta_5$ denotes the angle formed by the V-line and the straight line connected by the points P3 and P4 (as shown in FIGS. 7 and 9).

The $I_v$ and $I_{pf}$ are mutually coincided for the conventional piston 98 (as shown in FIG. 16) while the $I_v$ and $I_{pf}$ are not overlapped but outwardly diverged in apart with a distance I between the point $P_1$ and the point $P_0$ for the piston 5 of the present invention (as shown in FIG. 6) so that an angle $\theta_1$ is formed by the XY-plane and slant air acting face 54 of the piston head 52 in the piston 5, which means the air acting face 54 of the piston head 52 is not perpendicular to the piston rod 51 of the piston 5 but inclined with an angle $\theta_1$.

Please refer to FIGS. 7 and 8. In the air compressor of the present invention, the V-line intersects the hypothetical $Y_2$-line at point $P_6$ but intersects the hypothetical $Y_1$-line in no way (as shown in FIG. 8). Thereby, an angle $\theta_5$ is formed by the straight line connected by the points $P_3$ and $P_4$ relative to the normal V-line, which means the arrangement of the proximal coupling aperture 22 and distal coupling aperture 21 in the mounting chassis 2 is not parallel with the Z-axis or normal V-line initiated from internal central point of the cylinder 3 but inclined with an angle $\theta_5$ (as shown in FIG. 7).

Conversely, in the conventional air compressor as shown in the FIGS. 16 and 17, the V-line intersects the hypothetical $Y_2$-line and $Y_1$-line in same way (not shown in figures), which means the arrangement of the proximal coupling aperture 922 and distal coupling aperture 921 in the mounting chassis 90 is parallel with the Z-axis or normal V-line initiated from internal central point of the cylinder 3.

Accordingly, for the conventional air compressor as shown in FIG. 17, the piston rod 983 of the piston 98 directly links the eccentric crankpin 961 without intermediate connecting rod as motion converting means. Since the crankpin 961 moves from side to side with the rotary motion of the rotational crank cam 96, certain transverse forces applied on the sideways cylindrical inner wall 913 for the air chamber 911 of the cylinder 91 together with certain sideways gaps created between the cylindrical inner wall 913 of the cylinder 91 are incurred by the peripheral of the piston head 981, which is tilted in sideways sway manner by the rotary motion of the linking bore 932 at rear end of the piston rod 983.

Wherein, the transverse forces may incur an intolerable degree of wear on the piston 98 and cylinder 91 and increasing overall friction in the air compressor during forward stroke of the piston 98 while retard the returning speed of the piston 98 during whose backward stroke; and the sideways gaps may impair the airtight status of the air chamber 31 dynamically closed by the piston head 981 of the piston 98 during forward stroke of the piston 98.

For the purpose of solving foregoing two drawbacks of transverse forces and sideways gaps in the conventional air compressor, two innovative contrivances are worked out as below in the present invention.

In order to obviate the transverse forces caused by the sideways sway of the piston head 981 of the conventional air compressor (as shown in FIG. 17). In present invention, the proximal coupling aperture 22 and distal coupling aperture 21 in the mounting chassis 2 are bias arranged so that an angle $\theta_5$ are formed by the V-line and the straight line connected by the points P3 and P4 (as shown in FIGS. 7 and 9). By means of this way, during forward stroke of the piston 5, the piston 5 can moves in linear direction almost parallel with the Z-axis with less sideways sway as the Z-axis is also parallel with the cylindrical inner wall 312 of the cylinder 3.

In order to exploit the sideways gaps caused by the sideways sway of the piston head 981 of the conventional air compressor (as shown in FIG. 17). In present invention both of the inner top wall 311 in the air chamber 31 of the cylinder 3 and the air acting face 54 on the piston head 52 of the piston 5 are adapted into slant profile. By means of this way, during backward stroke of the piston 5, slant air acting face 54 of the piston rod 51 will be tilted in more sideways sway so that the piston head 52 of the piston 5 can expeditiously move in returning motion with less resisting force while the slant air acting face 54 of the piston 5 remains closely contact with the slant inner top wall 311 of the cylinder 3 during forward stroke of the piston 5.

Thus, once the motor 12 is turned power on for generating driving power out, the driving mechanism is initiated. Since the piston head 52 at the front end of the piston 5 is snugly confined by the straight cylindrical inner wall 312 of the cylinder 3, the piston rod 51 will convert the rotary motion of the linking bore 510 at the rear end thereof into a linear reciprocating motion of the piston head 52 at the front end thereof.

FIGS. 10 through 15 are progressive operation in stepwise manner showing linear reciprocating motion of the piston 5 in the cylinder 3 converted from the rotary motion of the eccentric crankpin 151/191 together with linking bore 510 of the piston rod 51 for foregoing exemplary preferred embodiments of the present invention, wherein the rotary motion of the eccentric crankpin 151/191 together with linking bore 510 is in clockwise (CW) manner.

Figure 10:
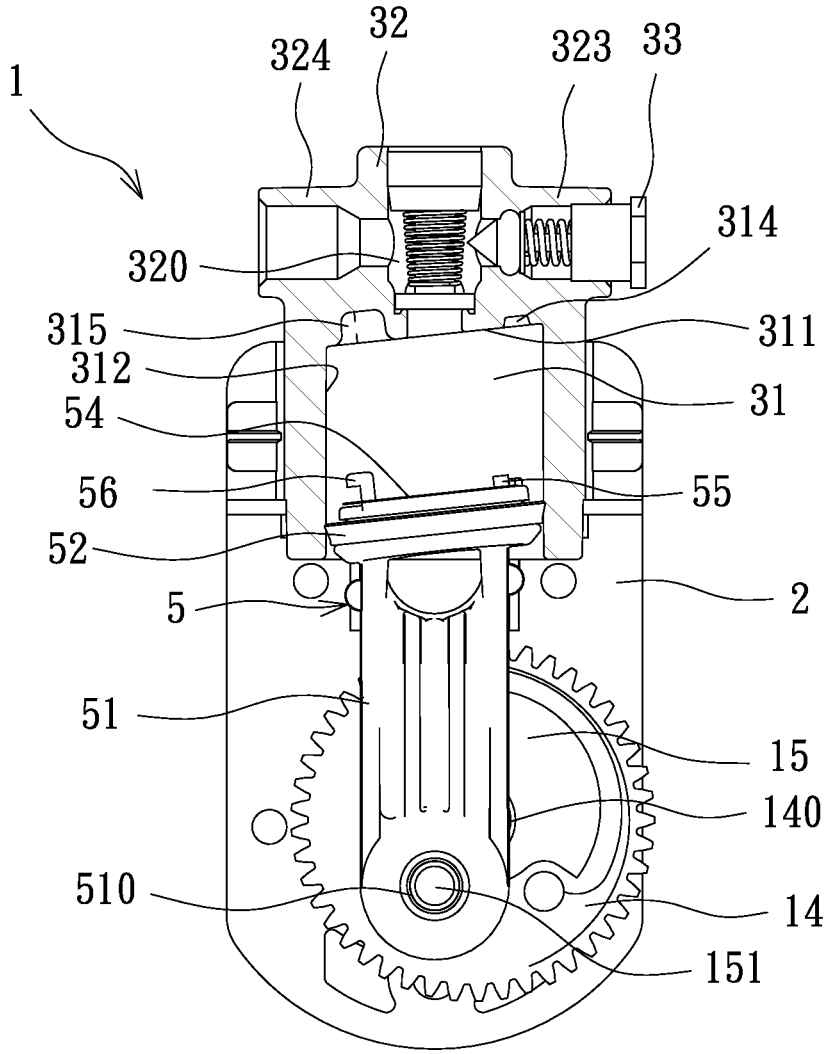
FIGS. 10 through 15 are progressive operation views showing piston motion in cylinder for foregoing exemplary preferred embodiments of the present invention.
Figure 11:
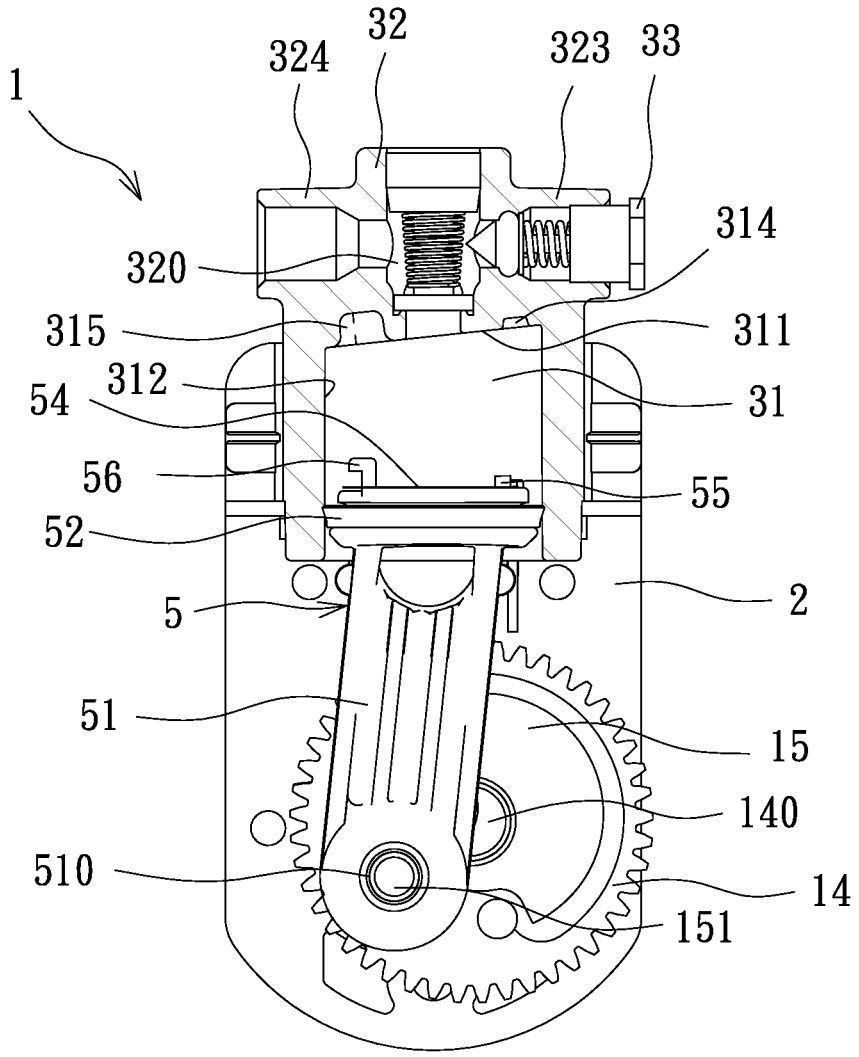
Figure 12:
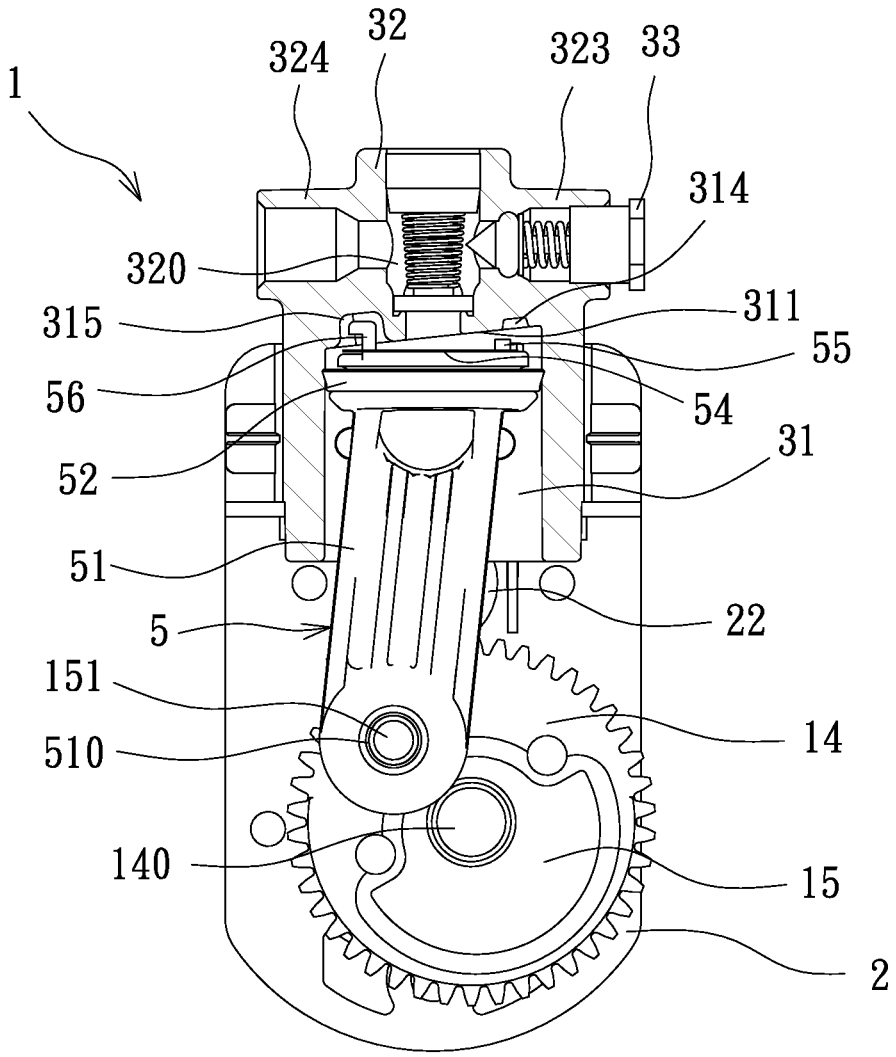
Figure 13:
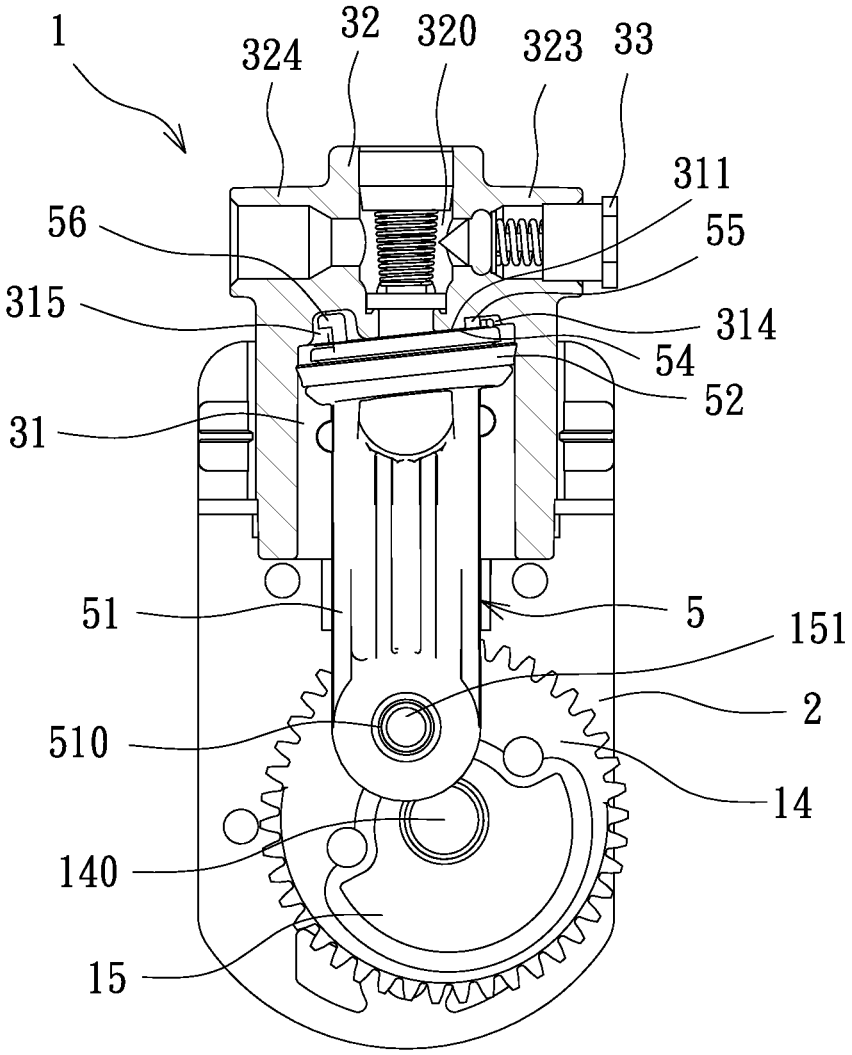

Step 1 as shown in FIG. 10, the linking bore 510 of the piston rod 51 is in start point or idle point as the motor 12 is turned power off;

Step 2 as shown in FIG. 11, upon the motor 12 is turned power on, the linking bore 510 of the piston rod 51 starts to rotate in clockwise (CW) rotary motion to progress an angular pace of 60 degree (60°); Under such circumstance, since the piston head 52 at the front end of the piston 5 is snugly confined by the straight cylindrical inner wall 312 of the cylinder 3, the piston rod 51 will convert the rotary motion of the linking bore 510 into a linear reciprocating motion of the piston head 52 so that the piston head 52 will move forwards in one third (⅓) forward stroke; In this stage, the air in the air chamber 31 of the cylinder 3 will be initially compressed by the piston head 52 of the piston 5;

Step 3 as shown in FIG. 12, the piston head 52 will continuously move forwards in next third (⅓) stroke up to two third (⅔) forward stroke while the linking bore 510 of the piston rod 51 continuously rotate in clockwise (CW) rotary motion to progress up to angular pace of 120 degree (120°); In this stage, the air in the air chamber 31 of the cylinder 3 will be continually compressed by the piston head 52 of the piston 5 to the better compressed condition; and Step 4 as shown in FIG. 13, the piston head 52 will continuously move forwards in further next third (⅓) stroke up to full forward stroke such that the piston head 52 reaches the top returning or reflection point while the linking bore 510 of the piston rod 51 continuously rotate in clockwise (CW) rotary motion to progress up to angular pace of 180 degree (180°); In this stage, the air in the air chamber 31 of the cylinder 3 will be continually compressed by the piston head 52 of the piston 5 to the maximally compressed condition.

In the foregoing Steps 2 through 4 of the forward stroke of the piston 5, the piston 5 can moves in linear direction almost parallel with the Z-axis with less sideways sway as the proximal coupling aperture 22 and distal coupling aperture 21 in the mounting chassis 2 are bias arranged into an angle $\theta_5$ formed by the V-line and the straight line connected by the points P3 and P4 (as shown in FIGS. 7 and 9). Moreover, the slant air acting face 54 of the piston 5 can remain closely contact with the slant inner top wall 311 of the cylinder 3 during forward stroke of the piston 5.

Figure 14:
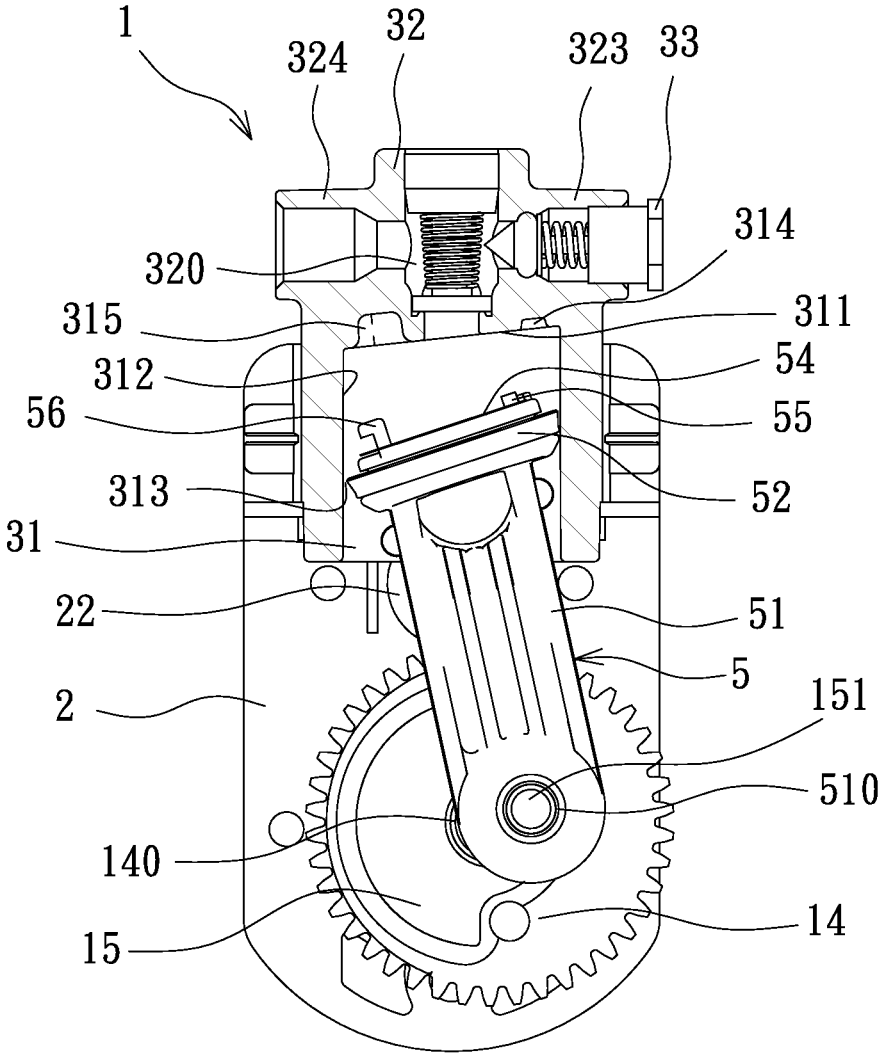
Figure 15:
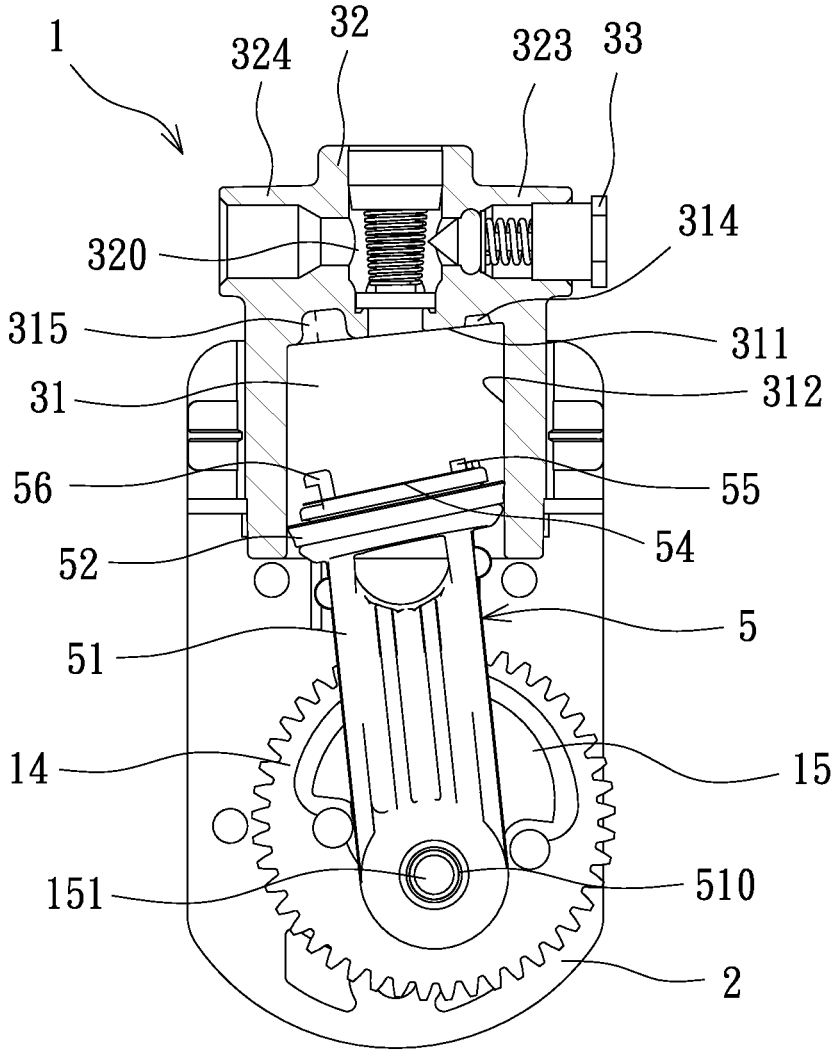

Step 5 as shown in FIG. 14, the piston head 52 will initially move backwards form the top returning or reflection point in two third (⅔) backward stroke while the linking bore 510 of the piston rod 51 continuously rotate in clockwise (CW) rotary motion to progress up to angular pace of 300 degree (300°); In this air releasing stage, no air compression happens in the air chamber 31 of the cylinder 3; and Step 6 as shown in FIG. 15, the piston head 52 will finally move backwards to full backward stroke while the linking bore 510 of the piston rod 51 continuously rotate in clockwise (CW) rotary motion to reach final point of the backward stroke, which is also the starting point of the next stroke cycle; In this air releasing stage, no air compression happens in the air chamber 31 of the cylinder 3.

In the foregoing Steps 5 through 6 of the backward stroke of the piston 5, the slant air acting face 54 of the piston rod 51 will be tilted in more sideways sway so that the piston head 52 of the piston 5 can expeditiously move in returning motion with less resisting force.

Thus, the piston head 52 can effectively compress the air in the air chamber 31 of the cylinder 3 during forward stroke of the piston 5, while the piston head 52 can be expedited in the cylindrical inner wall 312 of the cylinder 3 during backward stroke of the piston 5 so that overall air compressing effect for the air compressor of the present invention is substantially enhanced owing to better airtight property.

Please refer to FIGS. 9 through 15. The piston 5 further disposes a positioning peg 55 of metal reed (not shown) and a blocker 56 of metal reed (not shown) on the slant air acting face 54 while the cylinder 3 further disposes two dents 314, 315 on the slant inner top wall 311 to respectively mate with corresponding positioning peg 55 and blocker 56 on the slant air acting face 54 of the piston 5 so that both of the slant air acting face 54 and slant inner top wall 311 can mutually contact in better and effectively close attachment.

For contrastive comparison, the foregoing disclosure reflects the following facts. In conventional air compressor, the inner top wall 912 of the cylinder 91 and the air acting face 982 of the piston 98 are in flat profile. Whereas, in an air compressor of the present, the inner top wall of the cylinder 3 and the air acting face 54 of the piston 5 are adapted into slant profile. In the conventional air compressor, the V-line intersects the hypothetical $Y_2$-line and $Y_1$-line in same way, which means the arrangement of the proximal coupling aperture 22 and distal coupling aperture 21 in the mounting chassis 2 is parallel with the Z-axis so that the V-line consists with the straight line connected by the points $P_3$ and $P_4$ in overlapped manner. Whereas, in an air compressor of the present, the proximal coupling aperture 22 and distal coupling aperture 21 in the mounting chassis 2 are bias arranged so that an angle $\theta_5$ are formed by the V-line and the straight line connected by the points $P_3$ and $P_4$. By means of these structural features, the piston 5 in the present invention has following advantages that not only a better and effective airtight effect is achieved during forward stroke but also the returning speed of the backward motion is enhanced. Thereby, the integral air compressing effect in overall stroke cycle for the air compressor of the present invention is substantially enhanced. In conclusion from the disclosure heretofore, the present invention has structural novelty with surpass advantages over conventional air compressor of prior arts. Moreover, in practical usage, the overall air compressing effect of the present invention can be substantially enhanced.

I claim:

1. An air compressor, comprising:

a housing includes a cylinder and a mounting chassis with a proximal coupling aperture and a distal coupling aperture such that a hypothetically extended normal line initiated from the central point of the distal coupling aperture and extended in a direction toward a piston and perpendicular to the mounting chassis does not intersect with an axial line initiated from an internal central point of the cylinder, wherein said mounting chassis serves to fix a driving mechanism thereon and the proximal and distal coupling apertures are configured to accommodate the driving mechanism;

the piston includes a piston head at a front end thereof and a piston rod with a crankpin linking bore at a rear end thereof such that said crankpin linking bore can be driven by the driving mechanism while said piston head is accommodated by the cylinder for performing linear reciprocating motion therein;

wherein the top surface of said piston head of the piston is formed into an air acting face with a slant profile that is not a flat plane perpendicular to the piston rod; and wherein said cylinder includes an air chamber encompassed by an inner top wall, a cylindrical inner wall and the air acting face of the piston, such that the inner top wall is formed with a slant profile that is not a flat plane perpendicular to the longitudinal axis of the cylinder, said slant profile of the inner top wall corresponding with the slant profile of the air acting face on the piston head of the piston; and wherein the longitudinal axis of the piston rod is substantially parallel to the longitudinal axis of the cylinder when the piston head reaches a reflection point during the linear reciprocating motion.

2. The air compressor as claimed in claim 1, wherein said driving mechanism includes at least a motor having a shaft and a rotational crank cam with an eccentric crankpin, wherein the motor is securely mounted under the mounting chassis of the housing; the shaft integrates and links the mounting chassis, crank cam and piston with the motor by orderly running itself through the distal coupling aperture of the mounting chassis and a coupling bore of the crank cam; and the crankpin linking bore at the rear end of the piston receives the eccentric crankpin such that the eccentric crankpin snugly runs through the crankpin linking bore of the piston rod at the rear end of the piston in pivotal joint manner.

3. The air compressor as claimed in claim 1, wherein said driving mechanism further includes an actively driving pinion and a passively driven gear with a spindle, wherein the actively driving pinion, which securely mounts on a shaft of a motor and passes through the proximal coupling aperture in the mounting chassis; the passively driven gear mounts in the distal coupling aperture in the mounting chassis; both of the actively driving pinion and passively driven gear are mutually meshed together as an integral driving power relay; a rotational crank cam securely stacks over and simultaneously rotates with the passively driven gear in coaxial manner to the spindle; and an eccentric crankpin snugly runs through the crankpin linking bore at the rear end of the piston in pivotal joint manner.

4. The air compressor as claimed in claim 1, wherein said inner top wall further disposes two dents on the slant profile of the inner to wall.

5. The air compressor as claimed in claim 1, wherein a normal line initiated from a central point of the air acting face in the piston and a line specified by the pair of a central point of the crankpin linking bore and the central point of the air acting face on the piston are not overlapped but outwardly diverged in apart manner.

6. The air compressor as claimed in claim 1, wherein said mounting chassis and cylinder are unitarily formed into an integral entity of the housing.

7. The air compressor as claimed in claim 1, wherein said mounting chassis and cylinder are detachably jointed into an integral entity of the housing.

8. The air compressor as claimed in claim 1, the air acting face further disposes a positioning peg and a blocker on the slant profile thereof.

9. An air compressor, comprising:

a housing including a cylinder and a mounting chassis adapted to fix a driving mechanism thereon, the mounting chassis having a proximal coupling aperture and a distal coupling aperture configured to accommodate the driving mechanism, wherein the cylinder is mounted to one side of the mounting chassis such that a longitudinal central axis of the cylinder does not intersect a longitudinal central axis of the distal coupling aperture;

a piston including a piston head having a slant air acting face at a front end thereof and a piston rod having a crankpin linking bore at a rear end thereof, such that said crankpin linking bore can be driven by the driving mechanism while said piston head is accommodated by the cylinder for performing linear reciprocating motion therein;

wherein the cylinder comprises a slant inner top wall corresponding to the slant air acting face of the piston, and the slant air acting face of the piston head is not perpendicular to the piston rod of the piston; and wherein the longitudinal axis of the entire piston rod is substantially parallel to the longitudinal axis of the cylinder when the piston head is at full forward stroke such that the piston head reaches a top reflection point.

10. The air compressor as claimed in claim 9, wherein the cylinder includes an air chamber encompassed by the slant inner top wall, a cylindrical inner wall and the slant air acting face of the piston.

11. The air compressor as claimed in claim 9, wherein said driving mechanism includes at least a motor having a shaft and a rotational crank cam with an eccentric crankpin, wherein the motor is securely mounted under the mounting chassis of the housing; the shaft integrates and links the mounting chassis, crank cam and piston with the motor by orderly running itself through the distal coupling aperture of the mounting chassis and a coupling bore of the crank cam; and the crankpin linking bore at the rear end of the piston receives the eccentric crankpin such that the eccentric crankpin snugly runs through the crankpin linking bore on the piston rod at the rear end of the piston in pivotal joint manner.

12. The air compressor as claimed in claim 9, wherein said driving mechanism further includes an actively driving pinion and a passively driven gear with a spindle, wherein the actively driving pinion, which securely mounts on a shaft of a motor and passes through the proximal coupling aperture in the mounting chassis; the passively driven gear mounts in the distal coupling aperture in the mounting chassis; both of the actively driving pinion and passively driven gear are mutually meshed together as an integral driving power relay; a rotational crank cam securely stacks over and simultaneously rotates with the passively driven gear in coaxial manner to the spindle; and an eccentric crankpin snugly runs through the crankpin linking bore at the rear end of the piston in pivotal joint manner.

13. The air compressor as claimed in claim 9, wherein the longitudinal central axis of the cylinder intersects a longitudinal central axis of the proximal coupling aperture.

* * * * *